US007874753B2

(12) United States Patent
Domy et al.

(10) Patent No.: US 7,874,753 B2
(45) Date of Patent: Jan. 25, 2011

(54) DISPENSER FOR A COSMETIC, CLEANSING OR PHARMACEUTICAL COMPOSITION

(75) Inventors: Michel Domy, Cran Gevrier (FR); Pierre Mermoud, Frangy (FR)

(73) Assignee: Chanel Parfums Beaute (FR)

( * ) Notice: Subject to any disclaimer, the term of this patent is extended or adjusted under 35 U.S.C. 154(b) by 1169 days.

(21) Appl. No.: 10/588,136

(22) PCT Filed: Feb. 8, 2005

(86) PCT No.: PCT/FR2005/000280

§ 371 (c)(1),
(2), (4) Date: Sep. 13, 2006

(87) PCT Pub. No.: WO2005/079622

PCT Pub. Date: Sep. 1, 2005

(65) Prior Publication Data

US 2007/0274763 A1 Nov. 29, 2007

(30) Foreign Application Priority Data

Feb. 11, 2004 (FR) ..... 04 01377

(51) Int. Cl.
*B43K 5/16* (2006.01)

(52) U.S. Cl. ..... 401/99; 401/109; 401/131; 206/385

(58) Field of Classification Search ..... 401/99, 401/109–112, 131; 206/385; 200/523, 524
See application file for complete search history.

(56) References Cited

U.S. PATENT DOCUMENTS

| | | | | |
|---|---|---|---|---|
| 1,290,164 | A | 1/1919 | Fuller | |
| 2,485,161 | A | 10/1949 | Pampinella et al. | |
| 2,552,714 | A | 5/1951 | Gardiner | |
| 2,671,354 | A * | 3/1954 | Goos | 74/503 |
| 5,720,379 | A * | 2/1998 | Schwartz et al. | 200/318.1 |

FOREIGN PATENT DOCUMENTS

| | | |
|---|---|---|
| GB | 834486 | 5/1960 |
| GB | 859838 | 1/1961 |

* cited by examiner

*Primary Examiner*—David J Walczak
(74) *Attorney, Agent, or Firm*—DLA Piper LLP (US)

(57) ABSTRACT

A dispenser for cosmetic, cleansing or pharmaceutical composition including a tubular sleeve for housing the whole of a movable sub-assembly in the storage position thereof in such a way that the head of the movable sub-assembly is not accessible. A locking mechanism prevents outward movement of the movable sub-assembly in the storage position relative to the sleeve. When a user axially depresses the head in the opposite direction to the outward direction, the locking mechanism releases the movable sub-assembly, which is urged outward by a spring at least as a position I which the head projects outward from the sleeve.

16 Claims, 5 Drawing Sheets

DISPENSER FOR A COSMETIC, CLEANSING OR PHARMACEUTICAL COMPOSITION

RELATED APPLICATION

This is a §371 of International Application No. PCT/FR2005/000280, with an international filing date of Feb. 8, 2005 (WO 2005/079622 A1, published Sep. 1, 2005), which is based on French Patent Application No. 04/01377, filed Feb. 11, 2004.

TECHNICAL FIELD

The invention relates to a dispenser for dispensing a cosmetics, hygiene, or pharmaceuticals substance, and particularly, but not exclusively, to conditioning for sticks of lipstick.

BACKGROUND

Dispenser conditioning for sticks of lipstick is known that is in two portions, comprising a body having a tubular internal volume for receiving the lipstick, which volume is open at an axial end, and a sheath making it possible to close the axial end. The body is usually provided with a head mounted to pivot about the axis of symmetry of the body, and with an extraction mechanism making it possible to extract the stick of lipstick when the head pivots relative to the body.

GB 859 838 describes a lipstick sheath associated with a mirror. That sheath is mounted on a hinge of the frame of the mirror, and forms a cylinder for guiding a piston provided with tongues that clamp the tube of lipstick laterally. The end-wall of the sheath is provided with an ejection spring that pushes the piston away. The axis of ejection of the sheath is parallel to the axis of the hinge of the frame of the mirror. When the sheath is folded away against the mirror, the base of the tube of lipstick stands on a dish fastened to the frame of the mirror. When the mirror is pivoted, the piston is released and it drives the tube, while the spring relaxes. The tube remains held by the tongues in the ejection position, which makes it possible to prevent the tube from falling when taking hold of it. That principle is difficult to transpose to a tube that is presented without an associated mirror, because the lipstick tube is released directly by the movement of the dish associated with the mirror.

U.S. Pat. No. 2,552,714 describes a combined lipstick and applicator brush container whose sheath is subdivided into to portions: a narrow rigid sheath designed to receive the brush and a deformable sheath designed to receive the lipstick tube, which is itself provided with radial-holding lugs. A wall provided with a slot separates the two sheaths. The applicator is provided with a slide which is guided in the slot and which comes into abutment against the lipstick tube. A return spring urges the base of the applicator towards an ejected position. When, starting from the stowage position, the user depresses the wall of the sheath in the radial direction, the user releases the lugs. The spring relaxes and simultaneously drives the applicator and the lipstick tube towards the ejected position. It is then possible for the user to take hold of the lipstick tube and to use it in conventional manner. Unfortunately, on being ejected, the tube might fall because nothing holds it to the sheath. In addition, the use of a sheath with deformable walls is incompatible with the considerations of pleasing appearance and with the values of luxury conveyed by this type of substance.

It would therefore be helpful to provide a dispenser for dispensing a cosmetics, hygiene, or pharmaceuticals substance that limits the number of parts that are visible, and that is very simple and intuitive to use.

SUMMARY

The invention relates to a dispenser for dispensing a cosmetics, hygiene, or pharmaceuticals substance including a substantially tubular sheath defining an ejection axis and an axial ejection direction; a moving subassembly mounted to move relative to the sheath and having an end-wall and a drive element, the moving subassembly in a stowage position being received substantially entirely inside the sheath so that the drive element is substantially inaccessible, wherein the sheath and/or the moving subassembly define a space for receiving the substance; and a lock which, in a locked state, substantially prevents movement of the moving subassembly in the stowage position relative to the sheath in the ejection direction and, in an unlocked state, releases the moving subassembly and enables movement of the moving subassembly relative to the sheath in the ejection direction at least until the moving assembly reaches a projecting position in which the drive element projects at least partially outwardly of the sheath and is substantially accessible, the lock moving from the locked state to the unlocked state when the end-wall of the moving subassembly is pushed in by a user in the axial direction that is opposite from the axial ejection direction, from the stowage position to a pushed-in position.

BRIEF DESCRIPTION OF THE DRAWINGS

Other advantages and characteristics appear more clearly from the following description of selected aspects of the disclosure given by way of non-limiting examples and shown in the accompanying drawings, in which.

DETAILED DESCRIPTION

Figure 1:
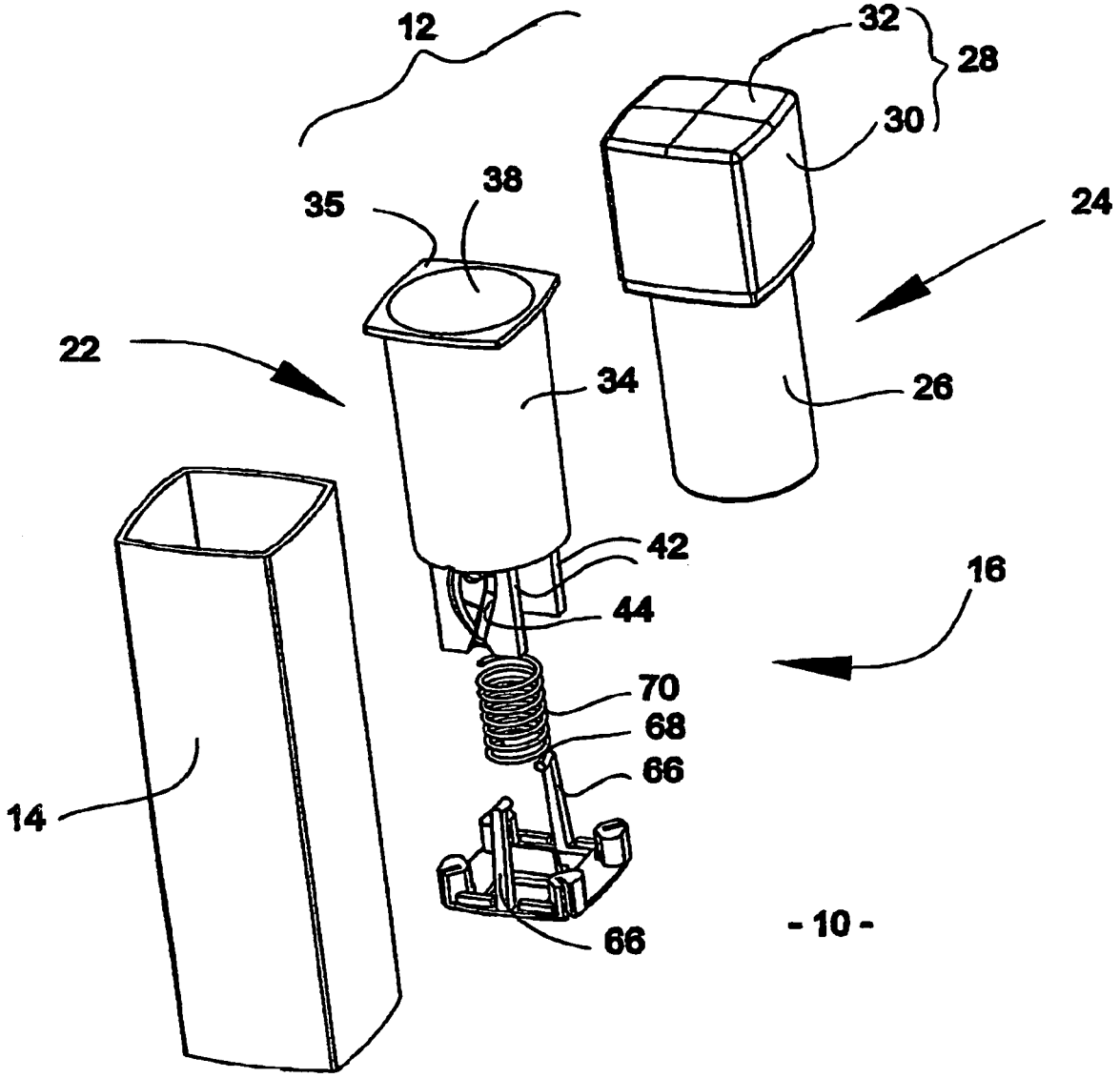
FIG. 1 is an exploded view of a lipstick dispenser.
Figure 4:
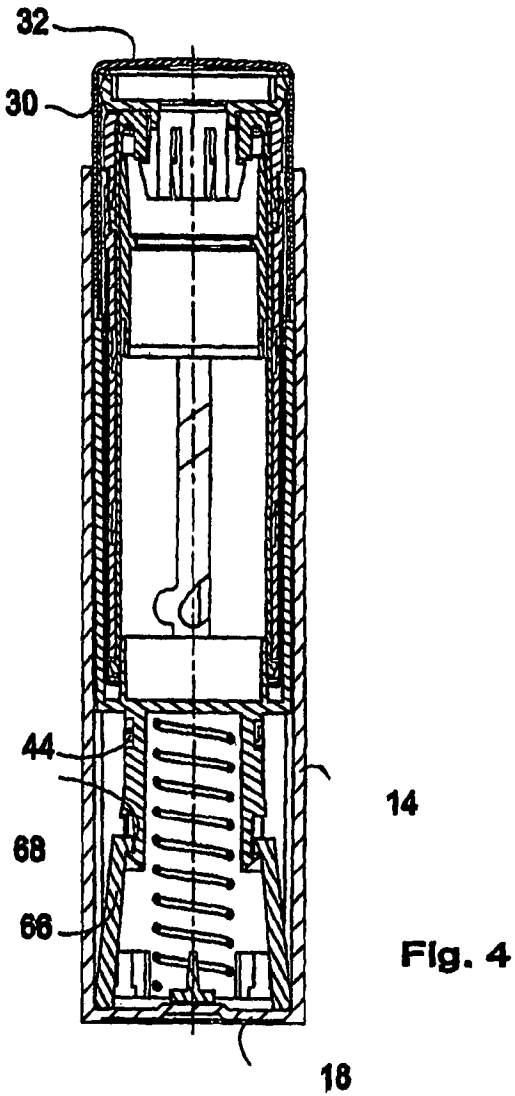
FIG. 4 shows the dispenser of FIG. 1, in the graspable position.
Figure 3:
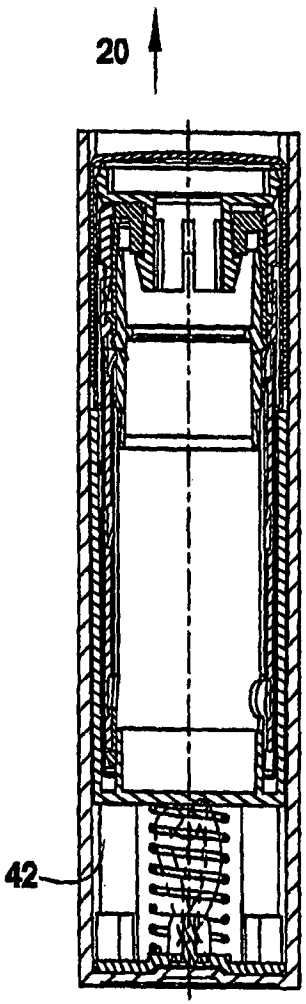
FIG. 3 is an axial section view of the dispenser of FIG. 1, in the pushed-in position.
Figure 2:
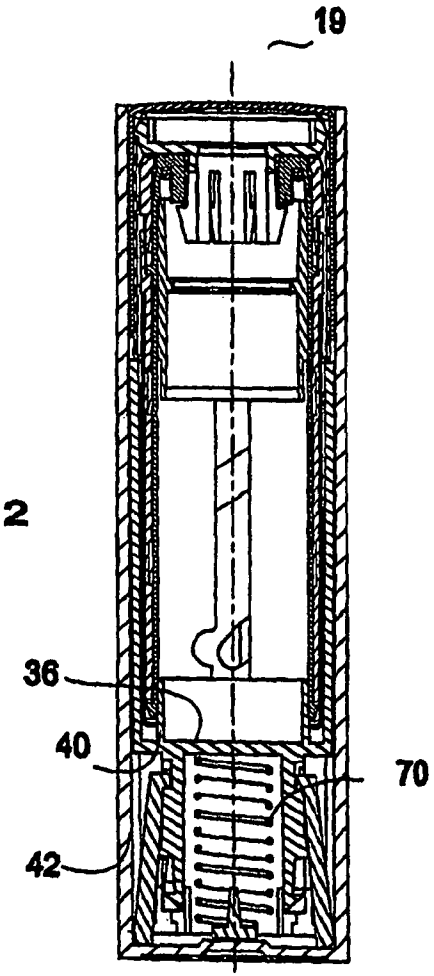
FIG. 2 is a view in axial section of the dispenser of FIG. 1, in the stowage position.

We provide dispensers for dispensing a cosmetics, hygiene, or pharmaceuticals substance comprising:

- a tubular sheath defining an ejection axis and an axial ejection direction;
- a moving subassembly mounted to move relative to the sheath and having an end-wall and a drive element, the moving subassembly in a stowage position being received entirely inside the sheath so that the drive element is inaccessible;
- a space for receiving the substance, which space is defined in the sheath and/or in the moving subassembly; and
- locking means which, in a locking state, prevents movement of the moving subassembly in the stowage position relative to the sheath in an ejection direction and, in an unlocking state, release the moving subassembly and make it possible for the moving subassembly to move relative to the sheath in the ejection direction at least until it reaches a projecting position in which the drive element projects to the outside of the sheath and is accessible, the locking means going from the locking state to the unlocking state when the end-wall of the moving subassembly is pushed in by a user in the axial direction that is opposite from the axial ejection direction, from the stowage position to a pushed-in position.

The ejection operation is extremely simple. The risks of untimely ejection are reduced because the mechanism does not require the head to be brought out of the sheath.

The drive element, which makes it possible to use the moving subassembly once it has reached the projecting position, can take different forms and perform different functions. When the dispenser requires taking hold of the moving subassembly, in particular with a view to separating it from the sheath, the drive element may be a portion of the end-wall, e.g. a radial surface, dedicated to taking hold of the moving subassembly. The drive element may also comprise a push button for controlling a valve or a pump, if the substance to be dispensed is in fluid form. It may also be a tongue for opening an orifice for dispensing the substance.

Preferably, the moving subassembly is guided relative to the sheath such that the pushing-in of the end-wall of the moving subassembly is a movement in translation without any movement in rotation relative to the sheath. From the user's point of view, the movement in translation is particularly simple and intuitive.

Preferably, the dispenser further comprises drive means for driving the moving subassembly, in the ejection direction, from the pushed-in position to the projecting position. The drive means may comprise a compression spring urging the moving subassembly to return in the ejection direction. Ejection is automatic so that it is not necessary to turn the dispenser upside down in order to access the graspable surfaces.

The moving subassembly may comprise: an applicator for applying the substance, which applicator defines the space for receiving the substance, and is provided with the end-wall of the moving subassembly; and moving equipment disposed inside the sheath and provided with retaining means for retaining the applicator relative to the moving equipment.

The moving equipment constitutes an intermediate subassembly that remains hidden from the user and that can carry at least some of the locking and/or guiding functions which remain hidden from the user and make it possible to keep a pure shape for the body.

Preferably, an end-of-stroke abutment preventing axial movement of the moving equipment relative to the sheath in the ejection direction beyond the position taken up by the moving equipment when the moving subassembly is in the projecting position. The abutment holds the moving equipment inside the sheath.

Preferably, the retaining means are such that they release the applicator when the moving subassembly is in the projecting position and when an axial force is exerted on the end-wall of the moving subassembly in the ejection direction. In a very simple manner, the retaining means may be constituted, for example, of a radially elastically deformable ring or by a clamping thimble provided with fingers that clamp the axial end of the tube by elastic deformation so that mere movement in traction suffices to release the tube.

The locking means may comprise at least two moving parts that move relative to each other in a telescopic motion. This telescopic relative movement makes it possible, for a given axial overall size in the stowage position, to maximize the stroke towards the graspable position.

The moving equipment may be one-piece. The one-piece moving equipment can thus perform a plurality of functions, e.g. the locking function, with complementary means secured to or integral with the sheath, the tube-holding function, and the function of co-operation with the end-of-stroke abutment and/or the function of guiding the moving subassembly relative to the tube.

The locking means may comprise at least one moving element co-operating with an abutment when the locking means are in the locking state, the moving element and the abutment moving relative to each other in a disengagement movement that includes a non-axial component when the locking means go from the locking state to the unlocking state. The relative movement of the moving element relative to the abutment can be obtained.

The sheath may be closed at one axial end by a sheath end-wall and, at its other axial end, has an opening that is closed off by the end-wall of the moving subassembly in the stowage position, the ejection axial direction going from the sheath end-wall towards the opening. In the stowage position, the appearance of the dispenser is particularly pure. There is no risk of making a mistake about the drive movement required for extracting the moving subassembly from the sheath because only one type of movement is authorized.

To the extent possible, references used to describe the structure shown in FIG. 1 are also used for describing identical or similar portions of the other structures.

As shown in FIGS. 1 to 5, a lipstick dispenser 10 is made of a moving subassembly 12 that is received in a sheath 14 of polygonal section and that is held stationary in a locked position by a locking mechanism 16.

The sheath 14 is closed by an end-wall 18 at one axial end, and is open at the opposite axial end, thereby defining an ejection axis 19 and an ejection direction 20 for the moving subassembly 12. To simplify the description, it is assumed below that the dispenser is disposed with its ejection axis in a vertical orientation and with its ejection direction upwards. Naturally, the dispenser can in practice be used in all positions.

The moving subassembly 12 comprises moving equipment 22 supporting a conventional lipstick tube 24. The lipstick tube is constituted of a holder cylinder 26 for receiving the stick of lipstick (not shown), which cylinder is open at one end and closed by an head 28 at its opposite end. The head 28 comprises a drive element made up of an end-wall 32 and of a graspable radial surface 30. A conventional mechanism (not shown) makes it possible to extract the stick of lipstick from the holder cylinder 26 when a user takes hold of the head 28 and turns it relative to the cylinder 26 about the axis thereof.

Figure 5:
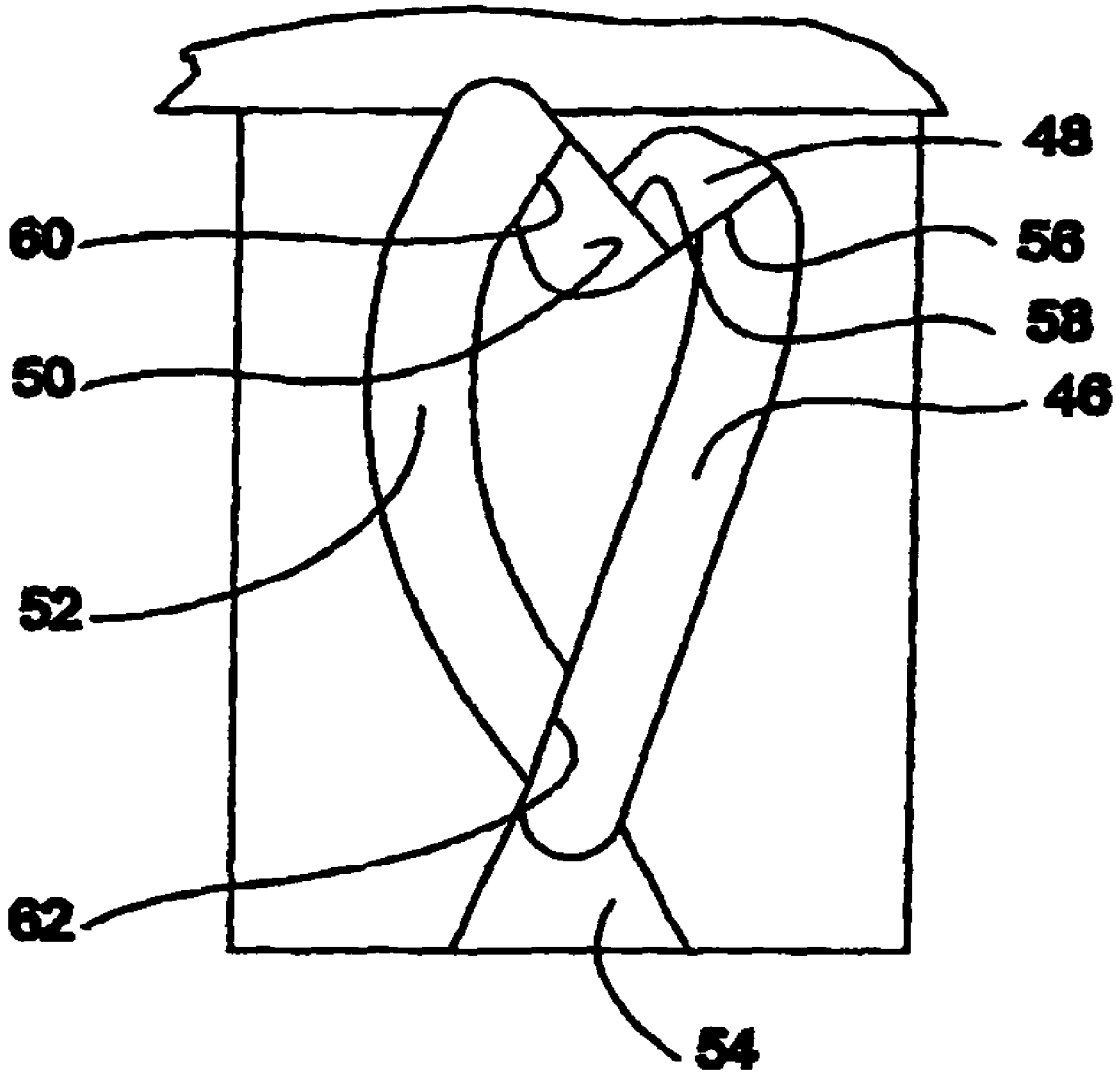
FIG. 5 shows a detail view of a heart-shaped cam of the FIG. 1 dispenser.
Figure 6:
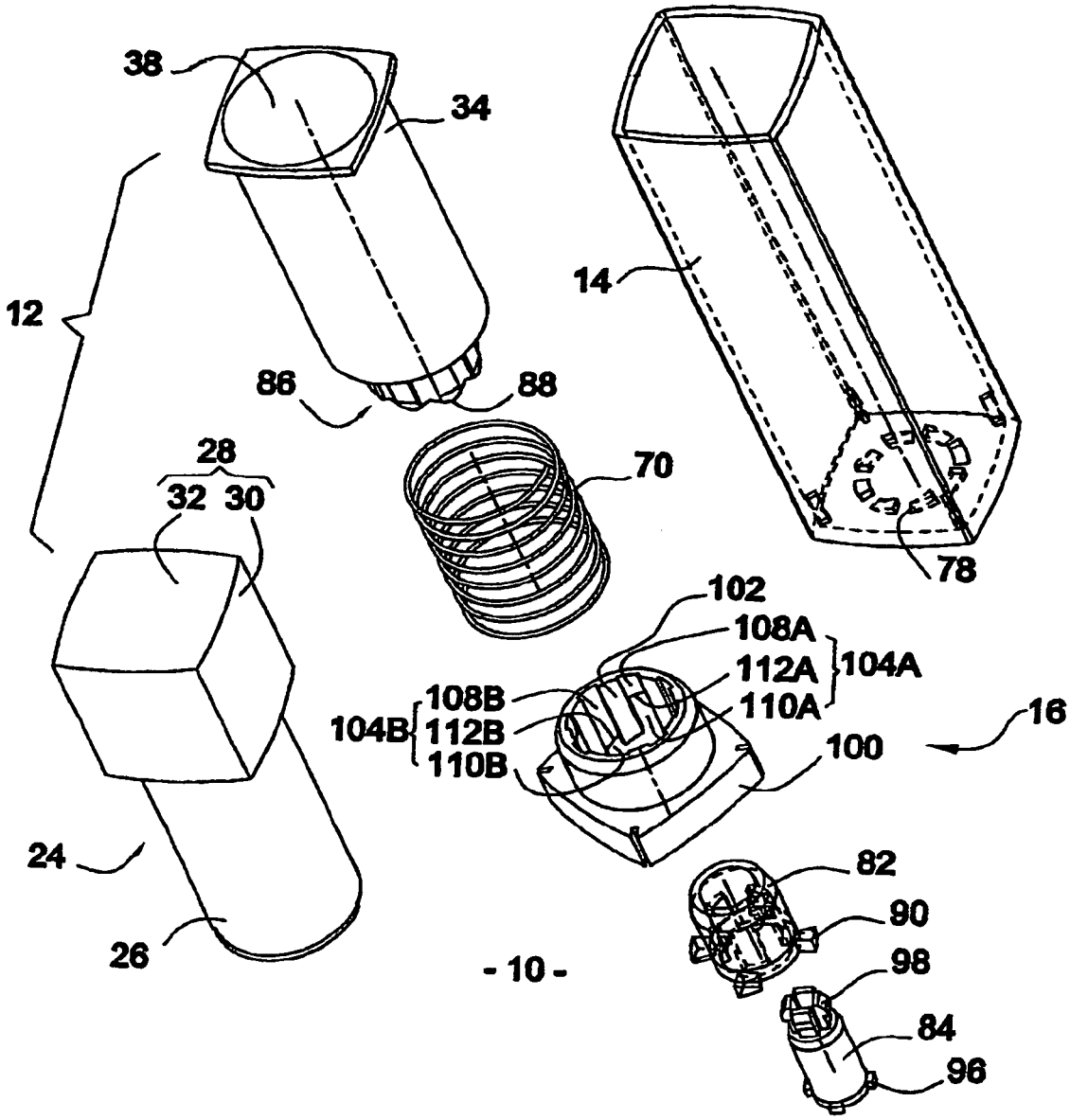
FIG. 6 is an exploded view of another dispenser.
Figure 9:
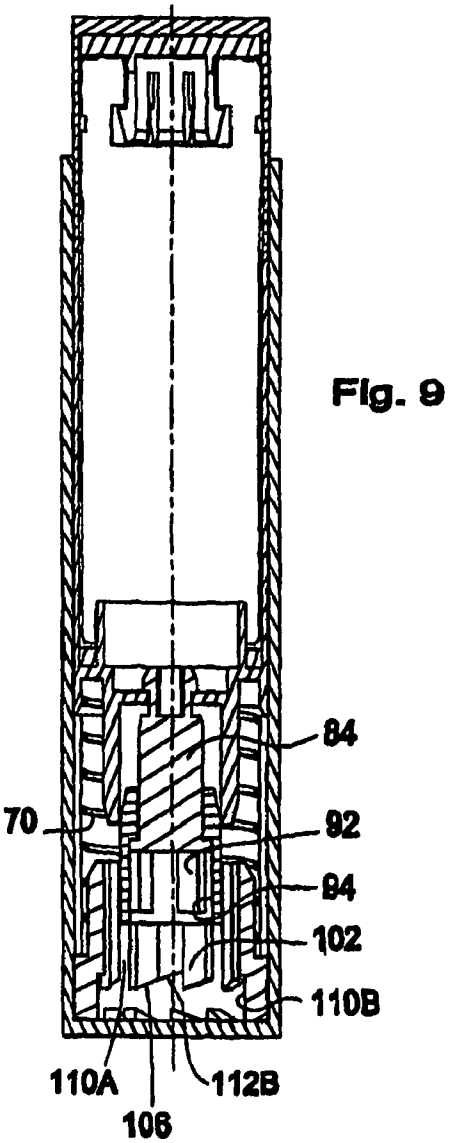
FIG. 9 is a view in axial section of the FIG. 6 dispenser, in the graspable position.
Figure 8:
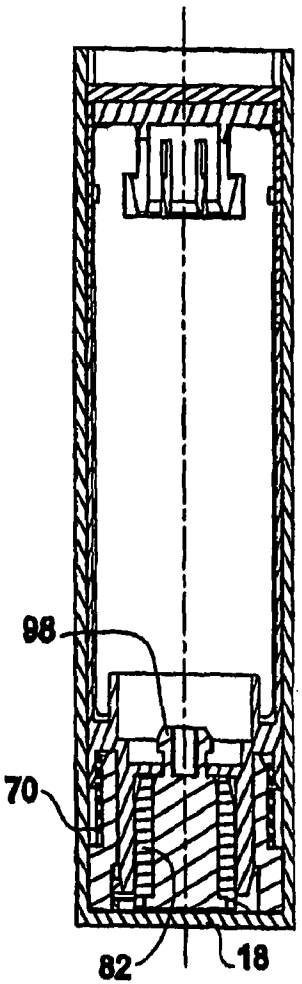
FIG. 8 is a view in axial section of the FIG. 6 dispenser, in the pushed-in position.

The moving equipment 22 is formed by a one-piece multipurpose part constituting a guide outer cylindrical sleeve 34 provided with a collar 35, forming a guide piston mounted to slide in the axial direction, without moving in rotation, along the inside walls of the sheath 14, and closed by an intermediate partition 36 that separates a stowage volume 38 for stowing the lipstick tube and the mechanism 16. The intermediate partition 36 forms, on the stowage volume side, an internal ring 40 for retaining the lipstick tube 24 and, on same side as the mechanism 1, and projecting towards the end-wall 18 of the sheath, the intermediate partition forms two parallel bottom flanges 42 which are mutually symmetrical about an axial plane, and each of which is provided with a heart-shaped groove 44 that is shown in FIG. 5. Each groove 44 is stepped and has a high track 46, a semi-high track 48, a rest track 50, and a low track 52. A rising track 54 is also provided. Each of the tracks has a varying height that decreases continuously from one end of the track to the other, in the manner of a ramp defining a low point and a high point. The high point of each track is situated in the vicinity of the low point of the adjacent track, at a smaller depth than the low point of the adjacent tract, so that the tracks are separated from one another by steps 56, 58, 60, 62.

A clamp made up of two resilient fingers 66 is fastened to the end-wall of the sheath. The free ends of the fingers 66 form lugs 68 that are curved over radially inwards so as to come to be received in the groove 44. The groove tends to urge the fingers apart relative to a rest position, so that the fingers are in flexion and exert a resilient bearing force against the back of the groove 44. As a result, the steps 56, 58, 60, 62 constitute un-crossable non-return or check devices when the ends 68 of the fingers slide at the back of the groove 44. A helical compression spring 70 bears against the end-wall 18 of the sheath and against the partition 36 of the moving equipment, tending to push the moving equipment 22 in the ejection direction 20 in which it is ejected from the sheath.

The groove 44 thus constitutes a heart-shaped cam having a closed profile whose successive steps force the lug-forming ends 68 to travel over a counterclockwise path as shown in FIG. 5. By co-operating with the lugs 68 and with the spring 70, the groove defines a bistable mechanism imparting to the dispenser a four-stage operating cycle that is described below.

In the stowage position, the moving subassembly 12 constituted of the lipstick tube 24 and the moving equipment 22 is entirely disposed inside the sheath 14 which, in particular prevents access to the graspable surface 30 of the head. The end-wall 32 of the head 28, whose perimeter lies, with a very small amount of clearance, within the inside perimeter of the sheath 14, closes the sheath 14. That end of the tube 24, which is opposite from the head, forms a cylindrical edge that is wedged by interfitting over the internal ring 40 of the moving equipment, thereby securing the lipstick tube 24 to the moving equipment 22. The spring 70 urges the moving equipment 22 in the ejection direction, but the lugs 68 prevent any movement in that direction because they are in abutment against a side wall of the groove 44, at the end of the rest track 50 pointing towards the end-wall 18 of the sheath.

When a user pushes in the head towards the end-wall of the sheath by opposing the spring 70, the grooves 44 move relative to the sheath 14. The lugs 68 which cannot cross the rising step 58 separating the rest tract from the semi-high track, are guided to that end of the rest track 50 which is further from the end-wall until they cross the falling step 60 and find themselves on the low track 52, the step 60 then preventing any return towards the rest track 50. In doing so, the fingers 66 undergo bending towards the left of FIG. 3.

When the user ceases to press on the head 28, the spring 70 drives the moving subassembly 12 freely in the ejection direction until the lugs, which have traveled over the low track 52, cross the step 62 and are in abutment against the side wall of the groove 44, at the bottom end of the high track 46, without any possibility of returning. The ejection movement is only slightly braked by the collar 35, and possibly the sleeve 34, rubbing along the walls of the sheath 14, so that the ejection movement is progressive and not in pulses or surges. This effect, which is desired for reasons of the impression of luxury that it imparts to the device, can, if necessary be accentuated by providing imperfect sealing between the collar 35 and the walls of the sheath so that the equalization of the pressures on either side of the collar 35 during the ejection is not instant and causes slight suction in the closed portion of the sheath. At the end of this stage, the moving subassembly has then reached a graspable position in which the graspable side surface 30 of the head of the tube has become accessible, the tube 24 remaining held by tight-fitting engagement over the ring 40. It remains for the user merely to take hold of the head 28 via the graspable surface 30 and to extract the tube 24 by exerting a small amount of traction, thereby releasing the end of the tube that is wedged on the ring 40.

To put the tube 24 back in place in its sheath 14, the user merely pushes the tube 24 into the sheath 14. The tube 24 becomes wedged on the ring 40 while also pushing the moving equipment 34 towards the end-wall 18 of the sheath. The lugs 68 which are prevented from returning towards the low track 52 by the step 62, then travel along the high track 46 until they cross the step 56 and come into abutment against the wall of the groove 44 at that end of the semi-high track 48 which is further from the end-wall 18, thereby stopping the movement of the moving equipment. Optionally, the tube 24 travels over a short additional stroke to be completely wedged in the ring 40, while the moving equipment 22 is stationary.

As soon as the user ceases to exert pressure, the moving subassembly 12 is pushed away by the spring 70 which drives it towards the locked position, the lugs 68 crossing the step 58 between the semi-high track and the rest track and coming once again into abutment against the wall of the groove, thereby completing the use cycle.

Another representative structure is described below with reference to FIGS. 6 to 9. The lipstick dispenser has a moving subassembly 12 received in a sheath 14 and held stationary in a locked position by a locking mechanism 16. One end of the sheath 14 is closed by an end-wall 18 provided with a stationary toothed ring 78 which projects axially and whose teeth form ramps. The other end of the sheath 14 is open.

The moving subassembly 12 has moving equipment supporting a conventional lipstick tube 24, similar to the lipstick tube of FIG. 1 and made up of holder cylinder 26 for receiving the stick of lipstick (not shown), which cylinder is open at one end and closed by a head 28 at its opposite end. The head 28 has a radial graspable surface 30 and an end-wall 32. A conventional mechanism (not shown) makes it possible to extract the stick of lipstick (not shown) from the holder cylinder 26 when a user takes hold of the head 28 and turns it relative to the cylinder 26 about an axis thereof.

The moving equipment is formed by a guiding and fastening sleeve 34, by an intermediate cylindrical "turnstile" 82, and by an axial extender 84. The sleeve 34 is mounted to be free to move in translation while being prevented from moving in rotation inside the sheath, and it is closed at one end by an intermediate partition 36 separating a stowage volume 38 of the lipstick tube and the mechanism 16. On the stowage volume side, the intermediate partition 36 forms an internal ring 40 retain the lipstick tube 24, and, on the mechanism 16 side, and projecting towards the end-wall 18 of the sheath, the intermediate partition forms a fluted bottom axial extension 86 whose axial end forms axially projecting ramps 88. The turnstile 82 presents four radially projecting projections 90 shaped to form complementary ramps serving to co-operate on one side with the stationary toothed ring 78 of the end-wall of the sheath, and, on the other side, with the ramps 88 of the axial extension 86 of the sleeve. In its bottom portion, the inside face of the turnstile 82 is provided with sides 92 separated by fluting 94. The extender 84 is provided with radial protuberances 96 co-operating with the sides 92 and fluting 94 of the turnstile, and provided with four catches 98 that come to be inserted into a square-section recess in the partition 36 of the sleeve 34, thereby making it possible for the extender 84 to move in translation to a small extent relative to the sleeve 34, without moving in rotation.

A compression spring 70 is loaded between the shoulder of the cam 100 of the sheath and the intermediate partition 36 of the sleeve. The mechanism 16 is completed by a stationary cam 100 forming a cylindrical bushing, provided with sides 102 projecting radially towards the inside of the cam 100 and separated in alternation by guide grooves for guiding the turnstile 104A and by locking grooves 104B. The bottom axial ends of the sides 102 are shaped to form ramps 106.

Each of the grooves 104A, 104B has a shallow top portion 108A, 108B serving to co-operate only with the sides of the fluted extension of the sleeve 86, and a deeper bottom portion 110A, 110B that co-operates not only with the sides of the fluted extension of the sleeve 86, but also with the projections 90 on the turnstile so as to guide them axially, the two portions of different depths being separated from each other by a step 112A, 112B forming axial abutments for the projections 90. The step 112A separating the guide grooves 104A is remote from the end-wall 18 of the sheath, so that the portion 110A has a large axial dimension. The step 112B separating the locking grooves 104B is ramp-shaped and is situated in alignment with the ramp 106 of one of the adjacent sides, so that the bottom portion 110B finds itself very small.

Figure 7:
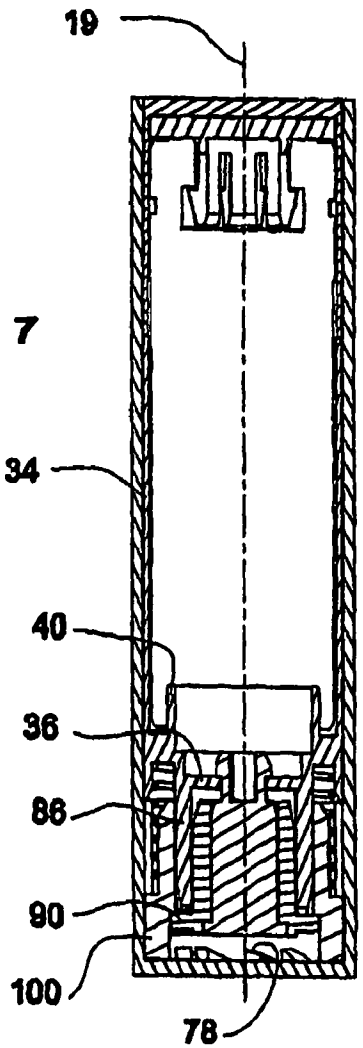
FIG. 7 is an axial section view of the FIG. 6 dispenser, in the stowage position.

The device operates as follows:

In the locked position, shown in FIG. 7, the tube 24 is stowed inside the sheath 14. The spring 70 is compressed and urges the moving subassembly 12 constituted of the tube 24 and the moving equipment to be ejected. However, the turnstile 82 is positioned such that the projections 90 are situated in the deep portions 104B of the locking grooves 104B, in axial abutment with the steps 112B of the locking grooves 105B in the stationary cam 100, and in lateral abutment with the side walls of the adjacent side 102, while the protuberances 96 of the extender 84 are in axial abutment against the sides 92 of the turnstile.

When the user presses on the end-wall 32 of the head 28, the moving subassembly 112 penetrates into the sheath 14. The ramps 88 of the fluted extension 86 of the sleeve come to push the projections 90 of the turnstile out of the locking grooves 104B so that the turnstile becomes free to move in rotation. The movement in translation of the ramps 88 continuing causes the projections 90 and the turnstile 82 to start moving in rotation about the ejection axis 19, that movement continuing until each of the projections 90 comes into engagement with two teeth of the stationary ring 78. The extender 84 then acts as a spacer between the sleeve 34 and the end-wall 18, and limits the penetration movement of the sleeve 34, so that the dispenser finds itself in the position shown in FIG. 8.

When the user ceases to press on the end-wall 32 of the head 38, the spring 70 pushes the sleeve 34 away which, after a lost-motion stroke corresponding to the axial clearance of the catches 98, starts to drive the extender 84, whose protuberances 96 are still in axial abutment against the step 114 of the side 92 of the turnstile 82. The ejection force of the spring 70 is then transmitted to the projections 90 which slide over the ramps 106 on the sides 102, and which retract, thereby causing the turnstile 82 to move in rotation. After this movement in rotation, the projections 90 find themselves in axial alignment with the guide grooves 104A while the fluting 94 finds itself facing the protuberances 96. The telescopic subassembly formed by the turnstile 82 and the extender 84 is driven in translation by the spring 70. The movement of the moving equipment stops when the projections 90 encounter the steps 112A of the guide grooves 104A and when the protuberances 96 come into abutment against the axial end 116 of the fluting 94. The tube is then in a graspable position shown in FIG. 9, enabling it to be extracted.

The tube is stowed in the following manner:

The tube 24 is inserted into the sleeve 34 and pushes the sleeve towards the end-wall 18 of the sheath. After a lost-motion stroke, the sleeve 34 starts pushing the extender 84. The fluted extension 86 of the sleeve penetrates into the bushing of the stationary cam 100 and pushes the turnstile 82 towards the end-wall of the sheath. As soon as the projections 90 on the turnstile 82 have gone past the bottom axial ends of the ramps 106 of the stationary cam 100, and as soon as the protuberances 96 of the extender have come out of the fluting 92 of the turnstile, the turnstile 82 becomes free to move in rotation again, and starts to move in rotation, driven by the axial end ramps 88 of the fluted extension of the sleeve. When the tube continues to be pushed in, the protuberances 96 are expelled from the fluting 94 while the projections 90 come into contact with the teeth of the stationary ring 78, which teeth constrain the turnstile to continue to move in rotation until the projections 90 are vertically in alignment with the ramps 106 of the stationary cam 100. After this movement in rotation, the extender 84 finds itself in axial abutment with the ends 114 of the sides 92 of the turnstile. The push-in movement is limited by the extender which acts as a spacer between the partition 36 and the end-wall 18.

When the user ceases to exert pressure, the spring 70 pushes the moving equipment away, the extender 84 transmits the axial forces from the spring 70 to the turnstile 82 and its projections 90, which slide along the ramps 106, until they penetrate into the locking grooves 104B, in abutment against the ramps 112B. The mechanism is then locked, and the cycle is complete, with the dispenser having returned to the position shown in FIG. 7.

Naturally, various modifications are possible.

In both of the structures described above, the sheath is polygonal in section, which makes it possible in particular for the lipstick tube to move in translation without moving in rotation relative to the sheath. Naturally, it is possible to use a sheath of circular section, in which case it can be necessary to provide axial guide means for axially guiding the tube and/or the moving equipment relative to the sheath.

The spring can be of any type, for example, it can be a traction spring or a compression spring. It can be loaded between a part that is stationary relative to the sheath and a part that is driven with the moving equipment.

The steps 56, 58, 60, and 62 are not obligatory, and the tracks can also be of constant depth and in the same plane. It then suffices, to obtain one-way guiding of the lugs, to modify the shape of the heart-shaped cam, in a known manner.

The structure can be simplified by omitting the extender if the resulting stroke is sufficient for the use in question.

It is possible to adhere a tamperproofing patch of self-adhesive paper to the end-wall of the head of the tube, which patch is provided with a side tab that folds over onto the outside radial surface of the sheath.

The term "lipstick tube" is to be understood in its generic meaning, and it designates any device defining a space for receiving a stick of make-up or salve, and provided with a mechanism making it possible to extract the stick for using it. The lipstick tube can also be replaced with an applicator that does not have a mechanism and that does not have an internal space for receiving a stick of lipstick, i.e. that is reduced merely to a head provided with a thimble for fastening a stick of lipstick. The lipstick can also be replaced with any type of applicator designed for cosmetics, hygiene, or pharmaceuticals use, and that is provided with a drive element enabling it to grasped, with a reservoir for the substance to be applied, and with means for extracting the substance from its reservoir. The substance to be applied can be a substance in liquid form or in powder form.

It is also possible to provide the space for stowing the substance in the sheath in a chamber that can be stationary or supported by the moving equipment. In which case, the lipstick tube mentioned in the preceding examples is replaced with an applicator, e.g. of the brush, pipette, or spatula type. It suffices for the applicator to be provided with a head similar to the head 28 of the above-described examples. For example, the applicator may, in the stowage position, be in contact with the substance. In another example, the applicator in the stowage position is separated from the chamber containing the substance to be applied. It is only when the head of the applicator is pushed in that the applicator penetrates into the chamber containing the substance, while the locking mechanism becomes unlocked and enables the applicator to be ejected.

It is also possible to apply the structure to a liquid dispenser such as a perfume dispenser, for example, to a valve or to a pump. The moving subassembly may be constituted of a flask or bottle provided with a dispensing nozzle on the side opposite from the end-wall and with moving equipment of the above-described type. By pressing on the end-wall, the locking means are released and the end-wall of the bottom is driven into a projecting position in which it projects relative to the sheath, so that it is possible to take hold of the end-wall of the bottle and extract it completely from the sheath for the purpose of accessing the nozzle. The moving subassembly may be a one-piece subassembly and not designed to come out of the sheath beyond the projecting position. The moving subassembly then has a head provided, for example, with a radial nozzle and with a drive button diametrically opposite from the nozzle, making it possible to control a valve or a pump. Preferably, the drive button should be driven by being pressed in a direction perpendicular to the axis of the sheath, e.g. a radial direction corresponding to the radial ejection axis of the nozzle, so as not to interfere with the axial movements of the moving subassembly relative to the sheath.

The purely axial movement of the tube may be transmitted to the locking mechanism 16, an element of which is moved in a movement having a non-axial component. This transformation of the axial movement into lateral movement can be obtained by any means.

The invention claimed is:

1. A dispenser that dispenses a cosmetics, hygiene, or pharmaceuticals substance comprising:

a tubular sheath defining an ejection axis and an axial ejection direction;

a moving subassembly mounted to move relative to the sheath and having an end wall a drive element, the moving subassembly as in a stowage position being received entirely inside the sheath so that a graspable radial surface is inaccessible;

a space that contains the substance, which space is defined in at least one of the sheath or the moving subassembly; and locking means which, in a locking state, prevent movement of the moving subassembly in the stowage position relative to the sheath in the ejection direction and, in an unlocking state, release the moving subassembly and enable movement of the moving subassembly relative to the sheath in the ejection direction at least until it reaches a projecting position in which the drive element projects at least partially outside of the sheath and is accessible, the locking means moving from the locking state to the unlocking state when the end-wall of the moving subassembly is pushed in by a user in the axial direction that is opposite from the axial ejection direction, from the stowage position to a pushed-in position.

2. The dispenser according to claim 1, wherein the moving subassembly is guided relative to the sheath such that the pushing-in of the end-wall of the moving subassembly is a movement in translation without movement in rotation relative to the sheath.

3. The dispenser according to claim 1, further comprising drive means for driving the moving subassembly, in the ejection direction, from the pushed-in position to the projecting position.

4. The dispenser according to claim 3, wherein the drive means comprise a compression spring urging the moving subassembly to return in the ejection direction.

5. The dispenser according to claim 3, further comprising brake means for braking movement of the moving subassembly in the ejection direction.

6. The dispenser according to claim 1, wherein the moving subassembly comprises:

an applicator for applying the substance, which applicator defines the space for receiving the substance, and is provided with the end-wall of the moving subassembly; and moving equipment disposed inside the sheath and provided with retaining means for retaining the applicator relative to the moving equipment.

7. The dispenser according to claim 6, further comprising an end-of-stroke abutment preventing axial movement of the moving equipment relative to the sheath in the ejection direction beyond the position taken up by the moving equipment when the moving subassembly is in the projecting position.

8. The dispenser according to claim 7, wherein the retaining means are such that they release the applicator when the moving subassembly is in the projecting position and when an axial force is exerted on the end-wall of the moving subassembly in the ejection direction.

9. The dispenser according to claim 6, wherein the moving equipment is one-piece.

10. The dispenser according to claim 1, wherein the locking means comprise at least two moving parts that move relative to each other in a telescopic motion.

11. The dispenser according to claim 1, wherein the locking means comprise at least one moving element co-operating with an abutment when the locking means are in the locking state, the moving element and the abutment moving relative to each other in a disengagement movement that includes a non-axial component when the locking means go from the locking state to the unlocking state.

12. The dispenser according to claim 11, wherein the abutment is secured to or integral with the sheath, and the moving element is secured to or integral with the moving subassembly.

13. The dispenser according to claim 12, wherein the abutment is stationary relative to the sheath.

14. The dispenser according to claim 11, wherein the locking means comprise a cam mechanism generating a disengagement relative movement when the moving subassembly goes from the stowage position to the pushed-in position.

15. The dispenser according to claim 14, wherein the cam mechanism comprises a cam having a closed profile.

16. The dispenser according to claim 1, wherein the sheath is closed at one axial end by a sheath end-wall and, at its other axial end, has an opening that is closed off by the end-wall of the moving subassembly in the stowage position, the ejection axial direction going from the sheath end-wall towards the opening.

* * * * *